US006709055B2

(12) United States Patent
Gengler et al.

(10) Patent No.: US 6,709,055 B2
(45) Date of Patent: Mar. 23, 2004

(54) CHAIR COVER

(75) Inventors: Charles Gengler, 355 Scotland Rd., South Orange, NJ (US) 07079; Robert E. Petner, Burlington, NJ (US)

(73) Assignee: Charles Gengler, South Orange, NJ (US)

( * ) Notice: Subject to any disclaimer, the term of this patent is extended or adjusted under 35 U.S.C. 154(b) by 67 days.

(21) Appl. No.: 10/033,283

(22) Filed: Dec. 21, 2001

(65) Prior Publication Data

US 2003/0117001 A1 Jun. 26, 2003

(51) Int. Cl.[7] ..... A47C 31/00
(52) U.S. Cl. ..... 297/228.13; 297/228.12
(58) Field of Search ..... 297/219.1, 226, 297/228.12, 228.13, 218.2, 218.1, 218.5

(56) References Cited

U.S. PATENT DOCUMENTS 1,962,215 A * 6/1934 Sallop
5,275,463 A * 1/1994 Rocha
5,509,718 A * 4/1996 Neary
5,806,925 A * 9/1998 Hanley
5,957,528 A * 9/1999 Campbell
6,309,017 B1 * 10/2001 Middleton

FOREIGN PATENT DOCUMENTS

WO WO 94/12366 * 6/1994

* cited by examiner

*Primary Examiner*—Milton Nelson, Jr.
(74) *Attorney, Agent, or Firm*—Stuart M. Goldstein

(57) ABSTRACT

A weather-proof covering of flexible material which is form fitted for use with a variety of outdoor furniture. A flexible harness with strap members is secured to the covering permanently by a sewed connection or removably by snaps, Velcro™, or similar devices. The harness is positioned and secured to the furniture by the members and tie lines which emanate from the harness and are tied to the furniture. This system attachment allows the cover to be used on furniture of varying sizes and configurations. The cover may also be attached to the furniture directly by snap connections. A bar with hooked ends is positioned through the bottom of the covering. It acts as a counterweight to keep the covering taut when it is deployed and covers the furniture. The bar also assists in storage of the covering directly on the furniture when the covering is not in use.

43 Claims, 4 Drawing Sheets

CHAIR COVER

BACKGROUND OF THE INVENTION

Furniture which is designed and constructed for the outdoors will often remain outside, subject to the elements, even when not in use. Whether left on a patio, deck, or outside a home, such furniture will be exposed to the weather, which, at the very least, will cause a build-up of dirt and grime on and, at worse, deterioration and destruction of the furniture. Existing furniture covers have been unsuccessful in addressing this problem for several reasons. Most covers are not adapted for easy deployment and placement over furniture, so they routinely are not used. Unless covers are readily available, they will not even be used. Covers which are not used are often put in locations remote from the furniture itself and are either forgotten or lost. Even when put in place, many covers will not remain in position, completely over the furniture, when they are exposed to elements of the weather such as wind and rain. They thus fail even to adequately serve the purposes for which they are intended.

SUMMARY OF THE INVENTION

It is thus the object of the present invention to overcome the limitations and disadvantages of prior outdoor furniture covers.

It is an object of the present invention to provide an outdoor furniture cover which is easy to deploy and place over furniture.

It is a further object of the present invention to provide an outdoor furniture cover which maintains its position on the furniture, even during windy and wet weather conditions.

It is another object of the present invention to provide an outdoor furniture cover which provides ease of removal from furniture and which can simply and quickly be compacted for storage.

It is still another object of the present invention to provide an outdoor furniture cover which can be compacted for convenient storage directly on the furniture, allowing for ready accessibility of the cover when it is needed.

The cover of the present invention comprises a weatherproof covering of flexible material which is form fitted for use with a variety of outdoor furniture. A flexible harness with strap members is secured to the covering permanently by a sewed connection or removably by snaps, Velcro™, or similar means. The harness is positioned and secured to the furniture by means of its strap members and tie lines which emanate from the harness and are tied to the furniture. This system attachment allows the cover to be used on furniture of varying sizes and configurations. The cover may also be attached to the furniture directly by snap connections. A bar with hooked ends is positioned through the bottom of the covering. It acts as a counterweight to keep the covering taut when it is deployed and covers the furniture. The bar also assists in storage of the covering directly on the furniture when the covering is not in use.

The novel features which are considered as characteristic of the invention are set forth in particular in the appended claims. The invention itself, however, both as to its design, construction, and use, together with the additional features and advantages thereof, are best understood upon review of the following detailed description with reference to the brief description of the drawings.

DETAILED DESCRIPTION OF THE INVENTION

Figure 1:
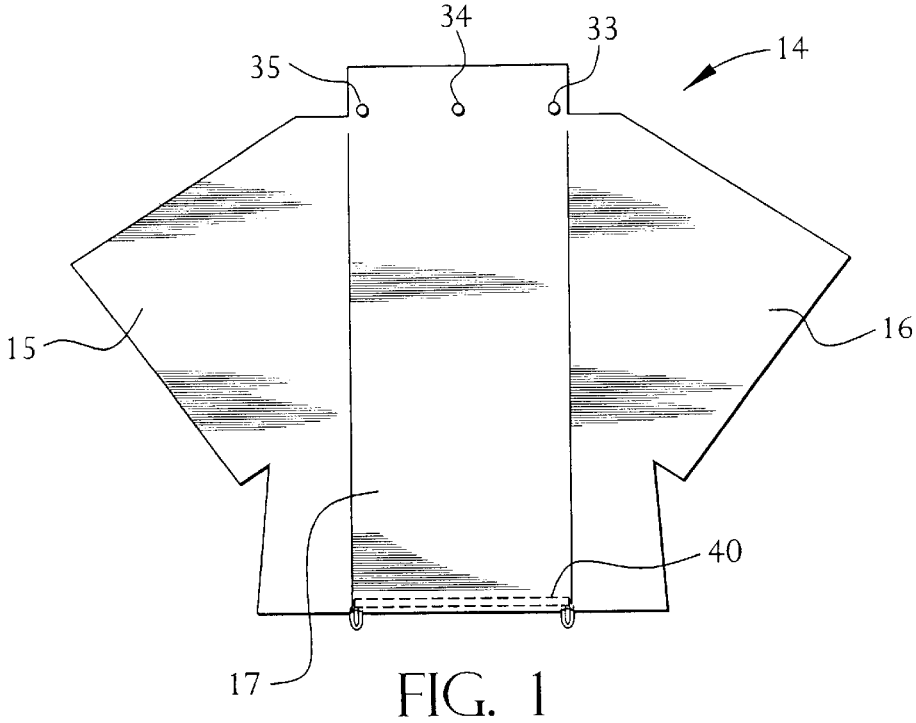
FIG. 1 is a view of the covering of the present invention laid out to show its configuration.
Figure 2:
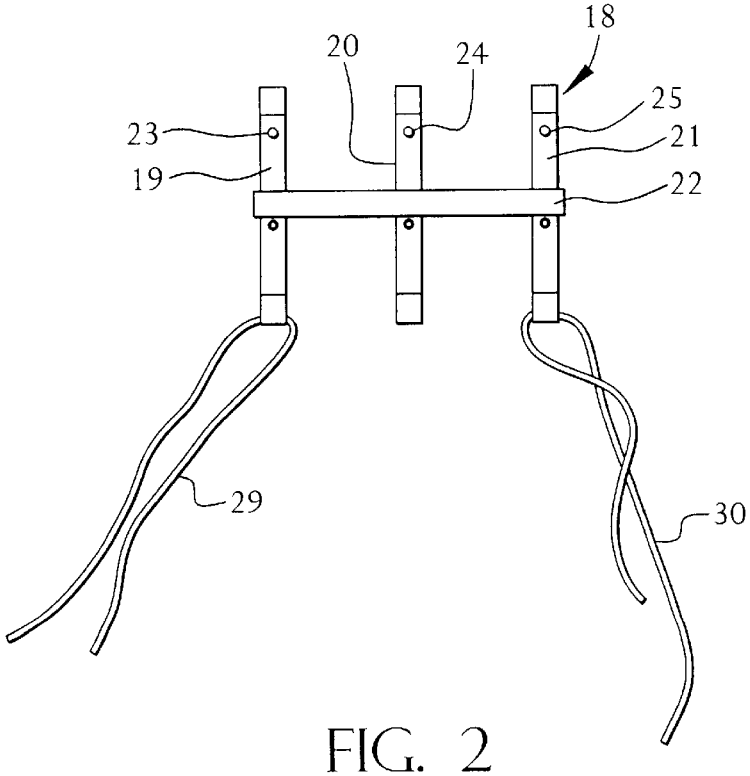
FIG. 2 is a view of the harness of the cover of the present invention.
Figure 3:
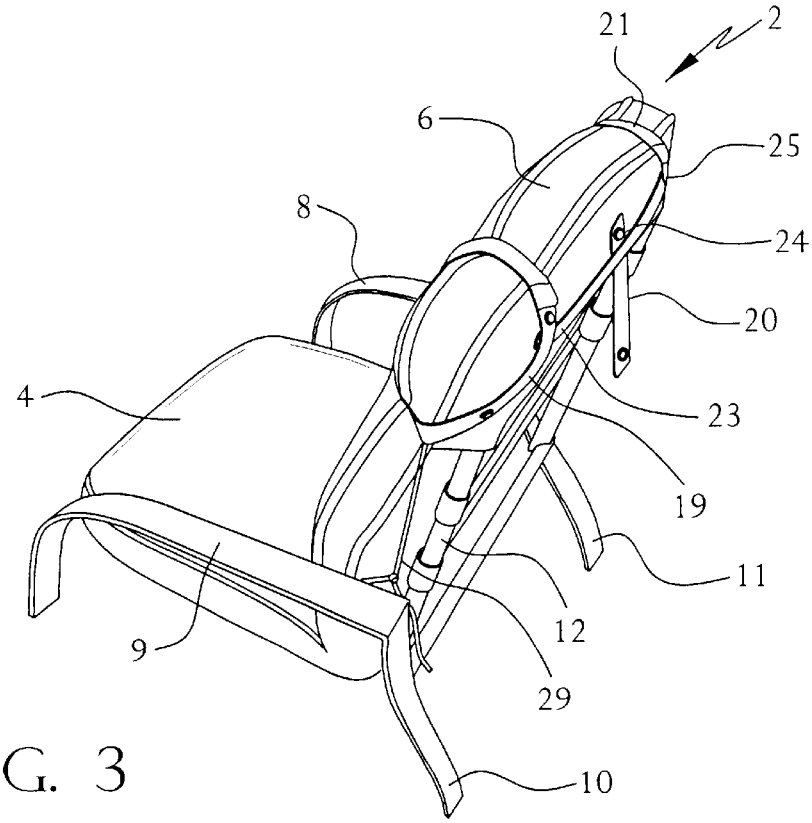
FIG. 3 is a view of the harness of the present invention attached to a chair.
Figure 8:
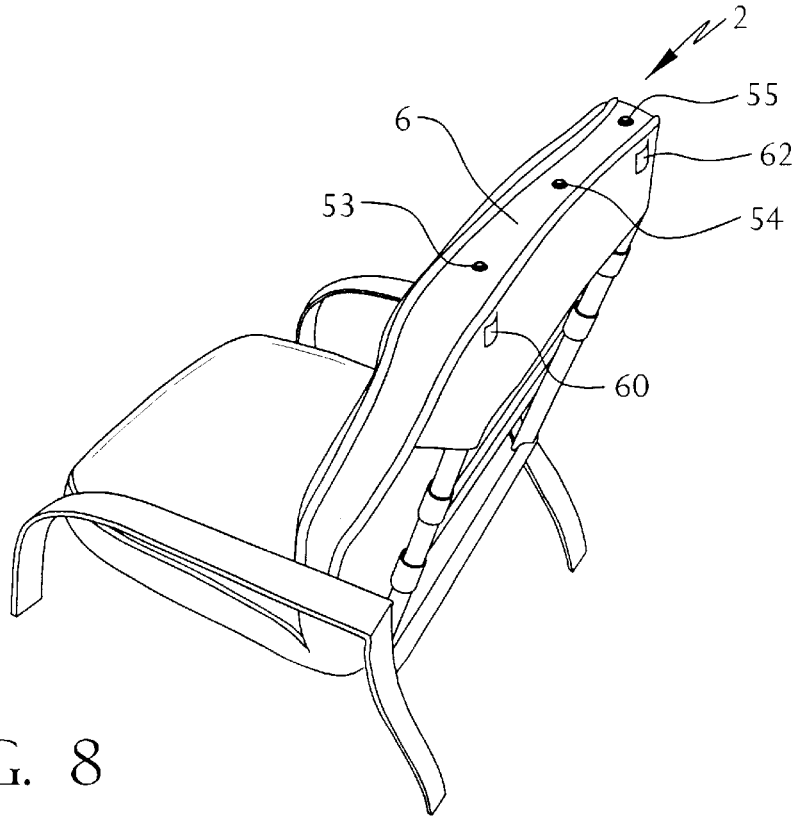
FIG. 8 is a view of an alternate embodiment of the manner of attaching the covering of the present invention to a chair.

Outdoor furniture, for example chair 2, comprises seat cushion 4, back cushion 6, handrails 8 and 9, legs 10 and 11, and frame 12. Chair 2 is to be protected by the cover of the present invention which includes covering 14, made of flexible water resistant and weather proof material, commonly used in the industry. Covering 14 is form fitted to be used not only on chair 2, but also on a wide variety of comparable chairs of different sizes and configurations. In this regard, it is contemplated that covering 14 will comprise side sections 15 and 16 and larger center section 17. By this configuration, covering 14 may readily be compacted, by folding side sections 15 and 16 onto center section 17, and then folding the covering over upon itself to form a compact unit, such as is shown at 48 in FIGS. 6 and 8.

Harness 18 is made of durable, yet flexible weather resistant material. It consists of three strap members 19, 20, and 21, which are fed through openings in transverse strap member 22. Snap connectors 23, 24, and 25 are located on strap members 19, 20, and 21 respectively. Covering 14 has snap connectors 33, 34, and 35 which are designed to mate with corresponding snap connectors 23, 24, and 25 respectively. Tie lines 29 and 30 extend from strap members 19 and 21, respectively.

It is contemplated that Velcro™ or similar temporary connectors may be used in lieu of the snap connections to attach harness 18 to chair 2 and harness 18 to covering 14. Harness 18 can also be sewn directly into covering 14 which provides a permanent connection between the harness and covering.

Figure 5:
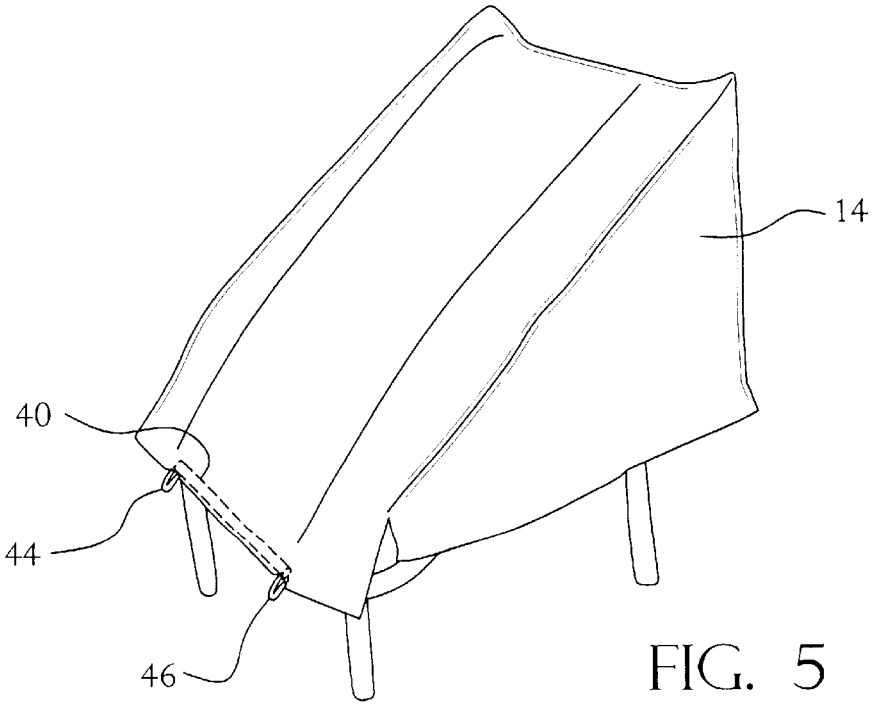
FIG. 5 is a view of the covering of the present invention deployed over a chair.
Figure 6:
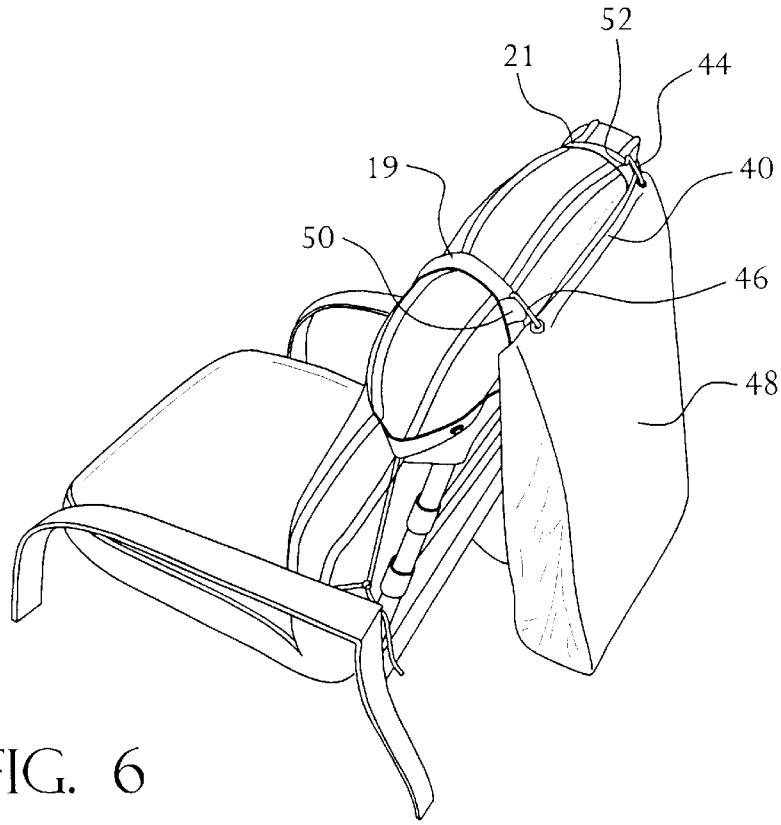
FIG. 6 is a view of the covering of the present invention stored on a chair.

As seen in FIGS. 5 and 6, bar 40 is inserted into a slot, located at the bottom of covering 14. Bar 40 has bent hook ends 44 and 46, which extend through and out of covering 14.

Figure 4:
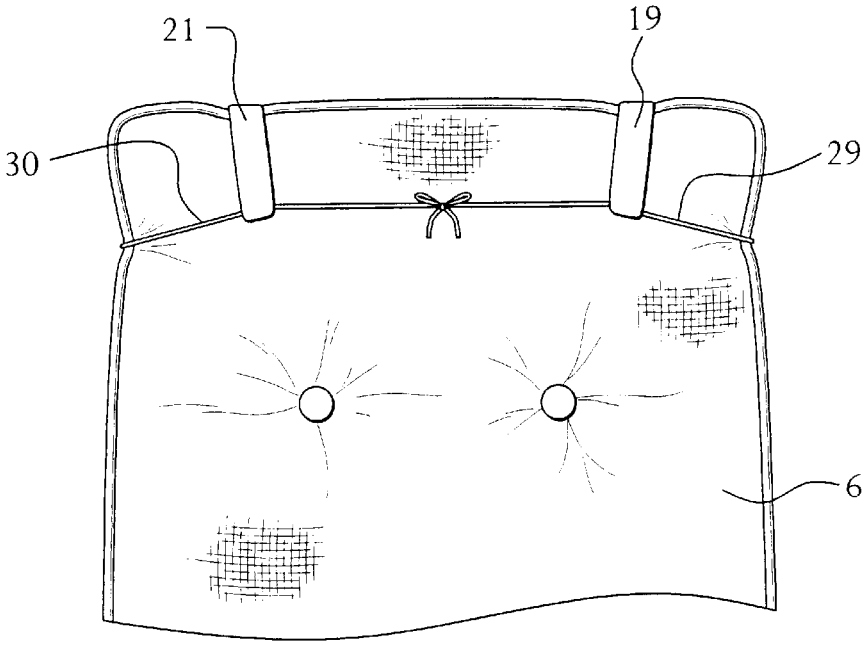
FIG. 4 is a front view of the back cushion of a chair with the harness of the present invention attached.

In operation, harness 18 is secured to chair 2 by placing strap members 19 and 21 around back cushion 6 and securing the strap members by tying lines 29 and 30 together at each end, as best shown in FIG. 4, and, at each of the other ends, frame 12 of chair 2 at handrails 8 and 9 or the intersection of the handrails and legs 10 and 11 of the frame. The use of tie lines 29 and 30 in this manner makes it possible to configure the harness 18 to chairs of virtually any size and shape.

After harness 18 is secured to chair 2, covering 14 is attached to the harness via snap connections 23/33, 24/34, and 25/35. Covering 14 is then deployed and extended over chair 2, covering it completely, as seen in FIG. 5. Bar 40 at the bottom of chair 2 acts as a counterweight to keep covering 14 taut. Additional tie lines may be added to covering 14 at its corners for securing the coverage when long term storage is desired.

Figure 7:
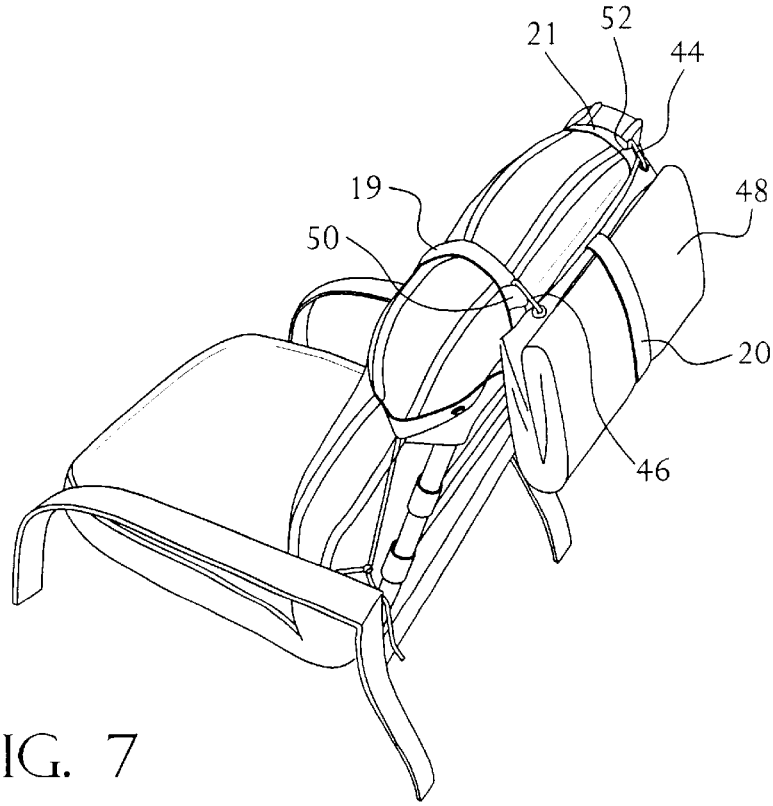
FIG. 7 is a view of the covering of the present invention stored and folded on a chair.

When chair 2 is to be used, covering 14 is removed from chair 2 and snap connections 13/33, 24/34 and 25/35 separated. Covering 14 is then folded into a compact unit, shown as 48 in FIG. 6. Hook ends 44 and 46 from bar 40 extend out and are hooked into holders 50 and 52, sewed or similarly secured to strap members 19 and 21. In this manner, covering 14, when not in use, can remain stored in compact form 48 on chair 2. Compact unit 48 can also be rolled up and secured with center tie 20, as shown in FIG. 7, for an even neater look.

When covering 14 must be redeployed, center tie 20 is simply taken off, compact unit 48 unfolded and covering 14 again spread out and over chair 2 and snap connectors 23/33, 24/34, and 25/35 reconnected.

In an alternative embodiment, snap connectors 53, 54, and 55 can be provided on cushion 6 itself. Covering 14 can then be directly secured to cushion 6. In this case, covering 14 can be deployed from cushion 6 and, when it is to be stored, it can be compacted and secured to chair 2 by hook ends 44 and 46 through holders 60 and 62 sewed or otherwise connected directly to cushion 6.

While the cover disclosed herein is shown in use with a chair, its use is contemplated with other furniture, such as chaise loungers, recliners, and other furniture which may benefit from protection from the elements.

Certain novel features and components of this invention are disclosed in detail in order to make the invention clear in at least one form thereof. However, it is to be clearly understood that the invention as disclosed, since it is apparent that various modifications and changes may be made without departing from the spirit of the invention.

What is claimed is:

1. A removable cover for placement over furniture, said cover comprising:

(a) covering means being configured to be deployed and to substantially cover the furniture for the protection of the furniture and to be compacted and remain secured to and stored on the furniture when the furniture is uncovered and the covering means is not in use;

(b) cover support means attached to the covering means for securing the covering means to the furniture, said cover support means being removably securable to the furniture;

(c) means to secure the cover support means to the furniture;

(d) means to attach the covering means to the cover support means; and (e) means to store the covering means on the furniture when the covering means is compacted and not in use.

2. The removable cover as in claim 1 wherein the covering support means comprises a harness.

3. The removable cover as in claim 2 wherein the harness comprises strap elements which overlay the furniture.

4. The removable cover as in claim 1 wherein the means to secure the cover support means comprises tie lines emanating from the cover support means.

5. The removable cover as in claim 4 wherein the cover support means comprises a harness.

6. The removable cover as in claim 1 wherein the means to attach the covering means comprises snap connectors located on the cover support means and the covering means.

7. The removable cover as in claim 1 wherein the means to attach the covering means comprises hook and loop fasteners located on the cover support means and the covering means.

8. The removable cover as in claim 1 wherein the means to attach the covering means comprises a sewed connection between the covering means and the cover support means.

9. The removable cover as in claim 1 wherein the covering means comprises a sheet of water resistant, weather proof material sized to be fitted over the furniture.

10. The removable cover as in claim 1 wherein the means to store the covering means comprises holders.

11. The removable cover as in claim 10 wherein the means to store the covering means further comprises hook means inserted into the holders.

12. The removable cover as in claim 1 wherein the means to store the covering means comprises hook means.

13. The removable cover as in claim 1 wherein the covering means comprises positioning means for maintaining the covering means in position over the furniture, whereby when the covering means is deployed and covered over the furniture, the positioning means constitutes a counterweight to maintain the integrity of the covering means over the furniture and whereby when the covering means is compacted and secured and stored on the furniture the positioning means provides the means to store the covering means on the furniture.

14. The removable cover as in claim 13 in which the positioning means comprises a bar with hooks.

15. A removable cover for placement over and attachment to furniture, said cover comprising:

(a) a harness comprising separate elements removably securable to furniture over which the cover is to be placed and attached;

(b) means to secure the harness elements to said furniture, said means being configured to secure the harness elements to furniture of varying shapes and sizes;

(c) a flexibly contoured covering sheet configured to be deployed and substantially cover the furniture and to be compacted for storage on that furniture;

(d) means attaching the covering sheet to the harness, whereby said attaching means maintains the attachment between the covering sheet and harness both when the covering sheet is deployed and substantially covering the furniture and when the covering sheet is removed from deployment and compacted and stored on the furniture; and (e) means to store the covering sheet on the furniture when the covering sheet is removed from deployment and compacted for storage.

16. The removable cover as in claim 15 wherein the means to secure the harness comprises tie lines emanating from the elements.

17. The removable cover as in claim 15 wherein the elements are flexible straps.

18. The removable cover as in claim 15 wherein the attaching means comprise snap connectors located on the covering sheet and the harness.

19. The removable cover as in claim 15 wherein the attaching means comprises hook and loop fasteners located on the covering sheet and the harness.

20. The removable cover as in claim 15 wherein the attaching means comprises a sewed connection between the covering sheet and the harness.

21. The removable cover as in claim 15 wherein the covering sheet comprises a sheet of water resistant, weather proof material sized to be fitted over the furniture.

22. The removable cover as in claim 15 wherein the means to store the covering sheet comprises holders secured to the harness.

23. The removable cover as in claim 22 wherein the means to store the covering sheet further comprises hook means inserted into the holders.

24. The removable cover as in claim 15 wherein the means to store the covering sheet comprises hook means.

25. The removable cover as in claim 15 in which the covering sheet comprises positioning means for maintaining the covering sheet in position on the furniture, whereby when the covering sheet is deployed and covered over the furniture the positioning means constitutes a counter-weight to maintain the integrity of the covering sheet over the furniture and whereby when the covering sheet is compacted and secured and stored on the furniture the positioning means provides the means to store the covering sheet on the furniture.

26. The removable cover as in claim 25 wherein the positioning means comprises a bar with hooks.

27. A removable cover for placement over and attachment to furniture, said cover comprising:

(a) a harness comprising separate elements removably securable to furniture over which the cover is to be placed and attached;

(b) tie lines emanating from the elements to attach the harness elements to said furniture, said tie lines being configured to secure the harness to furniture of varying shapes and sizes;

(c) a flexibly contoured covering sheet configured to be deployed and substantially cover the furniture and to be compacted for storage on that furniture;

(d) means attaching the covering sheet to the harness, whereby said attaching means maintains the attachment between the covering sheet and the harness both when the covering sheet is deployed and substantially covering the furniture and when the covering sheet is removed from deployment and compacted and stored on the furniture; and (e) means to store the covering sheet on the furniture when the covering sheet is removed from deployment and compacted for storage.

28. The removable cover as in claim 27 wherein the elements are flexible straps.

29. The removable cover as in claim 27 wherein the attaching means comprise snap connectors located on the covering sheet and the harness.

30. The removable cover as in claim 27 wherein the attaching means comprises hook and loop fasteners located on the covering sheet and the harness.

31. The removable cover as in claim 27 wherein the attaching means comprises a sewed connection between the covering sheet and the harness.

32. The removable cover as in claim 27 wherein the covering sheet comprises a sheet of water resistant, weatherproof material sized to be fitted over the furniture.

33. The removable cover as in claim 27 wherein the means to store the covering sheet comprises holders secured to the harness.

34. The removable cover as in claim 33 wherein the means to store the covering sheet further comprises hook means inserted into the holders.

35. The removable cover as in claim 27 wherein the means to store the covering sheet comprises hook means.

36. The removable cover as in claim 27 in which the covering sheet comprises positioning means for maintaining the covering sheet in position on the furniture, whereby when the covering sheet is deployed and covered over the furniture the positioning means constitutes a counter-weight to maintain the integrity of the covering sheet over the furniture and whereby when the covering sheet is compacted and secured and stored on the furniture the positioning means provides the means to store the covering on the furniture.

37. The removable cover as in claim 36 wherein the positioning means comprises a bar with hooks.

38. A removable cover for placement over furniture, said cover comprising:

(a) a flexibly contoured covering means configured to be deployed and to substantially cover furniture for the protection of the furniture and to be compacted and to remain secured to and stored on the furniture when the covering means is not in use;

(b) means on the furniture to removably secure the covering means to the furniture;

(c) means on the covering means to removably attach the furniture to the covering means whereby said attaching means maintains the attachment between the covering means and the furniture, both when the covering means is deployed and substantially covering the furniture and when the covering sheet is removed from deployment and compacted and stored on the furniture;

(d) means to store the covering sheet on the furniture when the covering sheet is removed from deployment and compacted for storage; and (e) positioning means for maintaining the covering means in position on the furniture both when the covering means is deployed and covered over the furniture and when the covering means is compacted for storage on the furniture.

39. The removable cover as in claim 38 wherein the means on the furniture to secure the covering means to the furniture comprises snap connectors.

40. The removable cover as in claim 38 wherein the means on the furniture to secure the covering means to the furniture and the means on the covering means to attach the furniture to the covering means comprises hook and loop fasteners.

41. The removable cover as in claim 38 wherein the means on the covering means to attach the furniture to the covering means comprises snap connectors.

42. The removable cover as in claim 38 wherein the means on the covering means to attach the furniture to the covering means comprises a harness.

43. The removable cover as in claim 38 wherein the positioning means comprises a bar with hooks.

* * * * *